US007474063B2

(12) United States Patent
Blake

(10) Patent No.: US 7,474,063 B2
(45) Date of Patent: Jan. 6, 2009

(54) ANTI-CYCLING CONTROL SYSTEM FOR LUMINAIRES

(76) Inventor: Frederick H. Blake, 3103 149th St. SE., Mill Creek, WA (US) 98012

( * ) Notice: Subject to any disclaimer, the term of this patent is extended or adjusted under 35 U.S.C. 154(b) by 268 days.

(21) Appl. No.: 11/441,375

(22) Filed: May 25, 2006

(65) Prior Publication Data

US 2006/0214607 A1 Sep. 28, 2006

Related U.S. Application Data

(60) Division of application No. 10/913,588, filed on Aug. 6, 2004, now Pat. No. 7,323,826, which is a continuation-in-part of application No. 10/636,680, filed on Aug. 7, 2003, now abandoned.

(51) Int. Cl.
*H05B 37/02* (2006.01)

(52) U.S. Cl. ..... 315/225; 315/291; 315/307; 315/360

(58) Field of Classification Search ..... 315/119, 315/129, 136, 149, 150, 158, 209 R, 225, 315/209 M, 291, 307, 308, 360, DIG. 7
See application file for complete search history.

(56) References Cited

U.S. PATENT DOCUMENTS 3,421,005 A 1/1969 Baker
3,609,451 A 9/1971 Edgerly, Jr.
3,621,269 A 11/1971 Misencik
3,670,202 A 6/1972 Paine et al.
3,995,262 A 11/1976 France
4,009,387 A 2/1977 Nuver
4,207,464 A 6/1980 Fukuyama et al.
4,207,500 A 6/1980 Duve et al.
4,236,101 A 11/1980 Luchaco
4,281,365 A 7/1981 Elving et al.
4,286,196 A * 8/1981 Auer ..... 315/307
4,463,284 A 7/1984 Tamura et al.

(Continued)

OTHER PUBLICATIONS

Pat Mann, "New device protects against cycling in HPS lamps"; Lighting Design; Oct. 22, 1993.

(Continued)

*Primary Examiner*—David Hung Vu
*Assistant Examiner*—Tung X Le
(74) *Attorney, Agent, or Firm*—Douglas J. Ryder; Ryder IP Law, PC

(57) ABSTRACT

An anti-cycling luminaire control system may detect repeated lamp-off conditions and interrupt power to the lamp and provide an indication of lamp cycling after a predetermined number of lamp-off conditions has been detected. The control system also provides a cool-off period after a lamp-off cycling event is detected during which time restarting of the lamp is inhibited. If the lamp does not restart after multiple restart attempts and cool-off periods, the system determines that a fault condition exists, and may provide a fault alert. The system may provide for shut-off or dimming of the lamp during the night after a portion of the night has passed. This delayed turn-off may be varied according to the length of the night. Starting and dimming the lamp at a zero voltage crossing of the line current can reduce stress on luminaire and control system components and reduce maintenance.

22 Claims, 8 Drawing Sheets

U.S. PATENT DOCUMENTS

| | | | | | |
|---|---|---|---|---|---|
| 4,467,246 | A | | 8/1984 | Tanaka et al. | |
| 4,473,779 | A | | 9/1984 | Lindner et al. | |
| 4,500,814 | A | | 2/1985 | Blake | |
| 4,533,854 | A | | 8/1985 | Northrup | |
| 4,587,459 | A | | 5/1986 | Blake | |
| 4,647,763 | A | | 3/1987 | Blake | |
| 4,665,346 | A | * | 5/1987 | Tarroux | 315/289 |
| 4,731,551 | A | | 3/1988 | Gibbs et al. | |
| 4,745,339 | A | | 5/1988 | Izawa | |
| 4,758,767 | A | | 7/1988 | Blake | |
| 4,810,936 | A | | 3/1989 | Nuckolls et al. | |
| 4,834,490 | A | | 5/1989 | Falkenstein et al. | |
| 4,853,599 | A | | 8/1989 | Singarayer | |
| 4,874,989 | A | | 10/1989 | Nissen | |
| 4,881,012 | A | | 11/1989 | Almering | |
| 4,949,018 | A | | 8/1990 | Siglock | |
| 4,962,336 | A | * | 10/1990 | Dodd et al. | 315/290 |
| 4,982,139 | A | | 1/1991 | Amir et al. | |
| 5,019,751 | A | | 5/1991 | Flory, IV et al. | |
| 5,070,279 | A | | 12/1991 | Garbowicz et al. | |
| 5,103,137 | A | | 4/1992 | Blake et al. | |
| 5,235,252 | A | | 8/1993 | Blake | |
| 5,331,214 | A | | 7/1994 | Mori et al. | |
| 5,381,077 | A | * | 1/1995 | McGuire | 315/247 |
| 5,471,119 | A | | 11/1995 | Ranganath et al. | |
| 5,650,694 | A | | 7/1997 | Jayaraman et al. | |
| 5,739,644 | A | * | 4/1998 | Bernitz et al. | 315/289 |
| 5,751,115 | A | | 5/1998 | Jayaraman et al. | |
| 5,770,925 | A | * | 6/1998 | Konopka et al. | 315/225 |
| 6,028,396 | A | | 2/2000 | Morrisey, Jr. et al. | |
| 6,388,399 | B1 | | 5/2002 | Eckel et al. | |
| 6,390,647 | B1 | | 5/2002 | Shaefer | |
| 6,548,967 | B1 | | 4/2003 | Dowling et al. | |
| 6,724,157 | B2 | | 4/2004 | Kazanov et al. | |
| 2002/0125837 | A1 | * | 9/2002 | Noda et al. | 315/225 |

OTHER PUBLICATIONS

M. Sharon Baker, "Inventor's eyes gleam at flickering stree lights"; Puget Sound Business Journal (Eastside Focus): Jan. 21-27, 1994, p. 8, Seattle WA USA.

Gail M. Robinson, "Smart Photoelectric Control Senses Lighting Problems"; Design News: Apr. 24, 1995; p. 99: Mill Creek, WA, US.

* cited by examiner

ANTI-CYCLING CONTROL SYSTEM FOR LUMINAIRES

CROSS REFERENCE TO RELATED APPLICATIONS

The present application is a Divisional of my copending application filed Aug. 6, 2004, Ser. No. 10/913,588 entitled Anti-Cycling Control System For Luminaires, which is a Continuation-in-Part of Ser. No. 10/636,680, filed Aug. 7, 2003, entitled Anti-Cycling Control System For Luminaires, now abandoned.

TECHNICAL FIELD

The field of the invention relates to electrical controls, and more particularly, to street lamps or luminaires the power to which is automatically supplied and cut-off at dusk and dawn, respectively.

BACKGROUND INFORMATION

High-pressure sodium lamps are well-known in the lighting field, and are currently in wide use by many city utilities for street lighting purposes. As a person skilled in the art would know, although such lamps have a long lifespan, they eventually fail over time, in part because of electrode depletion and deposition of the electrode material on the interior of the arc tube. This deposition results in heat retention, and, as the darkening of the arc tube increases, a point is reached where lamp voltage can no longer maintain a continuous arc. The result is a cycling condition in which the lamp continually flashes or attempts to start. The cycling is not always easy to detect and correct in a quick and cost-effective manner. Further, cycling can be visually distracting. It can also be annoying, especially in residential areas, as it can result in radio and television interference.

Conventional high pressure sodium lamps are typically photocell controlled when used in conjunction with street light installations. The photocell control, or in some cases, a timeclock, either enables power supply to the lamp, or cuts it off, depending on whether it is night or day. Power is typically supplied to the lamp by a pair of conventional electrically conductive wires or leads, and the photocell control is positioned in series in one of such leads.

FIG. 1, which is labeled "prior art," schematically illustrates the circuitry of a conventional, photosensor-controlled, high-pressure sodium lamp (without an anti-cycling control). Each lamp is normally powered by a line voltage which may be, for example, of 120 volts AC, provided by lines 1, 3. A photocell sensor control 5, positioned in series between the power source and the lamp, is used to differentiate between day and night, so that power can be supplied to the lamp at dusk and power can be discontinued at dawn.

In the evening, when the photosensor control 5 initially causes power to be supplied, the lamp is initially in an unlit condition. Such lamps have a ballast choke/transformer 7 with a secondary winding or coil 9 that is connected to a pulsing starter device 11. When power is initially supplied, the starter device 11 sends pulses to the secondary coil 9. This causes the ballast 7 to act as a step-up transformer that generates high voltage spikes of several thousand volts across the lamp's electrodes 13, 15, and consequently results in ignition of the lamp. Once ignition occurs, current flow through the ballast causes the lamp voltage to drop (typically from about 150 to 55 volts AC), and pulsing from the starter device 11 ends. If the lamp cannot hold ignition, the lamp will repeatedly attempt to restart. The lamp may restart and remain lit once it has cooled sufficiently to allow sodium ionization to once again take place.

Obviously, cycling is correctable by simply replacing a depleted lamp. However, if a cycling condition is allowed to continue over a period of time, it eventually damages the lamp's starter/ballast unit 7, 11, commonly by burning out the ballast 11. When this happens, the lamp ceases to cycle, but the starter/ballast unit must then be replaced along with the depleted lamp, resulting in higher overall costs of repair. For such reason, it is important to detect a cycling condition as soon as possible. In addition, the attempt to restart a cycling lamp may result in substantial radio frequency interference as the starter pulses the ballast with high voltage pulses.

From the standpoint of labor, many or most city utilities have no cost-effective means for quickly detecting when such lamps are cycling. The typical utility does not have large numbers of service personnel constantly checking street lamps at night, which is the only time cycling is apparent since such lamps normally do not operate during the day. As a result, cycling may continue for extended periods.

Furthermore, cycling is difficult to detect even in situations where service checks are made at night. Depending on the level of arc tube darkening, a cycling lamp may remain lit for several minutes or more before it loses its arc and attempts to restart. This may require a service person to visually monitor individual lamps for more than just a brief period of time in order to discover whether cycling is occurring.

Since high-pressure sodium lamps have a predicted service life, most city utilities have simply taken to automatically replacing groups of lamps at selected times after they have been placed in service, regardless of whether or not a significant number of such lamps have actually begun to cycle. This is inefficient because it too often results in an earlier than necessary lamp replacement, or replacement after many lamp ballasts have already been injured from cycling incidents, and consequently, does not make optimum use of each lamp.

Historically, high-pressure sodium lamps went into large-scale result of the energy shortages created by an Arab oil embargo in or about that time. High-pressure sodium lamps have approximately twice the energy efficiency of their predecessors, mercury vapor lamps, which were the most common street lamps in use before that time. The above-described cycling problem continues to be pressing, and must be solved in a way that will maximize the life of existing lamps in an easy-to-implement, cost-effective manner.

The patent literature discloses that few inventors or companies have yet had occasion to address the above problem. One notable exception involves the efforts of Area Lighting Research, a Hackettstown, N.J. company. Area Lighting is the assignee of two U.S. patents, one issued on Jun. 10, 1980 to Duve et al. (U.S. Pat. No. 4,207,500), and the other issued on Sep. 25, 1984 to Lindner et al. (U.S. Pat. No. 4,473,779). Both patents specifically relate to the cycling malfunction of high-pressure sodium lamps, and each offers a solution, albeit one that is different from the invention disclosed here. It should be mentioned in passing that both patents provide a much more detailed description of the cause of the cycling malfunction than the cursory explanation provided above.

Duve et al. discloses a cut-off device that activates a relay in response to a signal from a detector-signal generator that senses when the voltage increase across the lamp is greater in magnitude than the lamp's normal operating voltage. The increase in voltage corresponds to the lamp's attempt to relight itself. A timing circuit monitors the signal from the detector-signal generator, and determines whether the sensed increase in voltage constitutes undesirable cycling. If so, the timing circuit activates the relay, thus cutting off power to the lamp.

Lindner et al. claims to be an improvement over Duve, and determines cycling by sensing a change in lamp power factor. In doing so, Lindner uses the combination of both a voltage signal generator and a current signal generator which simultaneously transmit their signals to a comparator-processor, where the latter compares their phases. When their phases have a certain known relationship that corresponds to cycling, Lindner similarly activates a relay cutting off power to the lamp.

U.S. Pat. No. 5,103,137 to Blake, et al. discloses an anti-cycling device for high pressure sodium lamps that uses changes in lamp current to monitor lamp cycling and, after a certain number of cycling events, cuts off power to the lamp. The anti-cycling device has a current sensor connected in series to one lead between the photocell control and the lamp. Such sensor is operative to develop a continuous AC voltage signal that is generally proportional to the magnitude of the alternating current in the lead as current passes through the lamp. An extinguished lamp that either initially starts in the beginning of an evening, or attempts to restart as a result of cycling, draws higher than normal current levels. This, in turn, creates a higher than normal alternating voltage output from the sensor. In view of its teachings concerning the use of anti-cycling devices for high pressure sodium lamps, this patent is incorporated by reference herein.

In the device of this patent, a first amplifier is connected to the current sensor in a manner so that it continuously senses the sensor's voltage output, and generates an amplified AC voltage output signal whose magnitude is also generally proportional to the sensor voltage. This output is rectified by a set-point diode, and is transmitted to another amplifier. The second amplifier receives such signal and compares its magnitude to the level of a preselected threshold signal. The latter amplifier, in response to the first amplifier's output, is operative to output a trigger signal every time the first amplifier's rectified output exceeds the threshold level. A counter receives and counts each trigger signal transmitted from the second amplifier. It is programmed to output a malfunction or cut-off signal in the event it counts a certain preselected number of trigger signal transmissions (such as three) during a given time period. Once the preselected number of trigger signals is reached, a relay is activated to interrupt power to the lamp until the counter is reset. An LED may be turned on to indicate that the lamp is cycling and needs to be replaced. The device may be reset when the power to the lamp is turned off and then back on, as when the photocell sensor interrupts power upon detecting a daylight condition and then restores power when darkness is once again detected.

U.S. Pat. No. 6,028,396 to Morrissey, Jr., et al. discloses a system that includes detector circuitry for detecting the load drawn by the lamp and a microcontroller programmed to predict lamp condition, such as cycling and lamp-out conditions based on the detected load. The circuitry can shut the lamp off if a cycling condition is detected. A visual indication of the detected condition may be outputted by the circuitry.

As will become apparent, the present invention provides an anti-cycling device that is simpler in both design and operation than any of the devices discussed above. Further, the device disclosed here is low in cost, extremely reliable, and is equally well-suited for either retrofitting to street lamps presently in use, or factory installation by the lamp manufacturer.

SUMMARY OF THE INVENTION

In one aspect, the present invention provides an anti-cycling device that senses lamp current and interrupts power to the lamp upon detection of multiple instances of cycling. In another aspect, upon detecting a lamp cycling condition, the lamp control circuitry provides a lamp cool-down period prior to attempting to restart the lamp. In yet another embodiment, restarting of the lamp is timed to coincide approximately with the zero volt crossing of the alternating current power supply to reduce stress on the relay (contactor), ballast and other electrical components. In an additional aspect, the invention provides for selective turn-off of a lamp at selected times. Where ballast systems are used that allow dimming, the lamp may be dimmed rather than turned off. The dimming function may be disabled until the lamp has warmed up enough to support dimmed operation. In another aspect, the change between dimmed and full-brightness operation may be synchronized with a zero voltage crossing of the line voltage.

The invention will be better understood upon consideration of the following description, which is intended to be taken in conjunction with the attached drawings.

BRIEF DESCRIPTION OF THE DRAWINGS

In the drawings, like reference numerals and letters indicate like parts throughout the various views, unless indicated otherwise, and wherein.

DETAILED DESCRIPTION OF EMBODIMENTS OF THE INVENTION

The present invention provide means through which maintenance costs may be reduced for high intensity discharge streetlights, such as luminaires incorporating high pressure sodium lamps, as compared to the current maintenance costs resulting from current maintenance practices. In addition to reduced maintenance costs, energy savings may be achieved. Such reduction in power consumption is desirable not only for the economic benefit, but also because, to the extent fossil fuels are used to produce the electricity, the saving in power consumption results in a reduction in greenhouse gas output and reduction of other pollution. For example, based on estimated averages of luminaire power consumption of 150 watts, an energy cost of US$0.75 per kilowatt hour and 11.3 hours of operation per day, a 10% reduction in energy consumption could reduce electric power use by 1.73 billion kilowatt hours per year in the U.S. alone. Savings of 30% and 40% could produce annual savings on the order of 5.2 and 6.92 billion kilowatt hours. At these rates, a 30% saving in power consumption for the U.S. in luminaire operation could result in annual cost savings of about US$390 million and millions of tons of carbon dioxide output.

Figure 1:
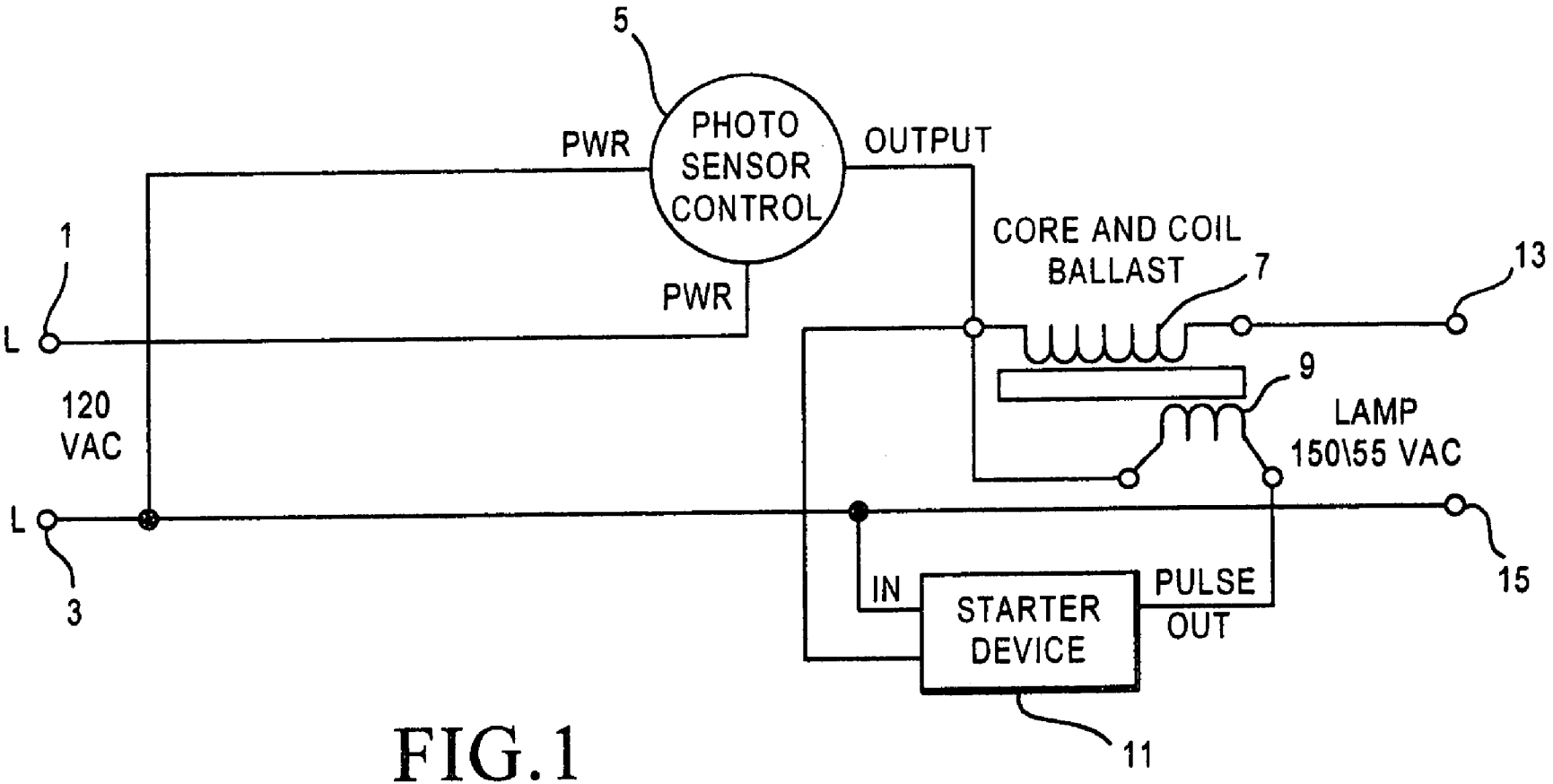
FIG.1 PRIOR ART
FIG. 1 is a schematic representation of prior-art high pressure sodium lamp circuitry without anti-cycling circuitry.
Figure 2:
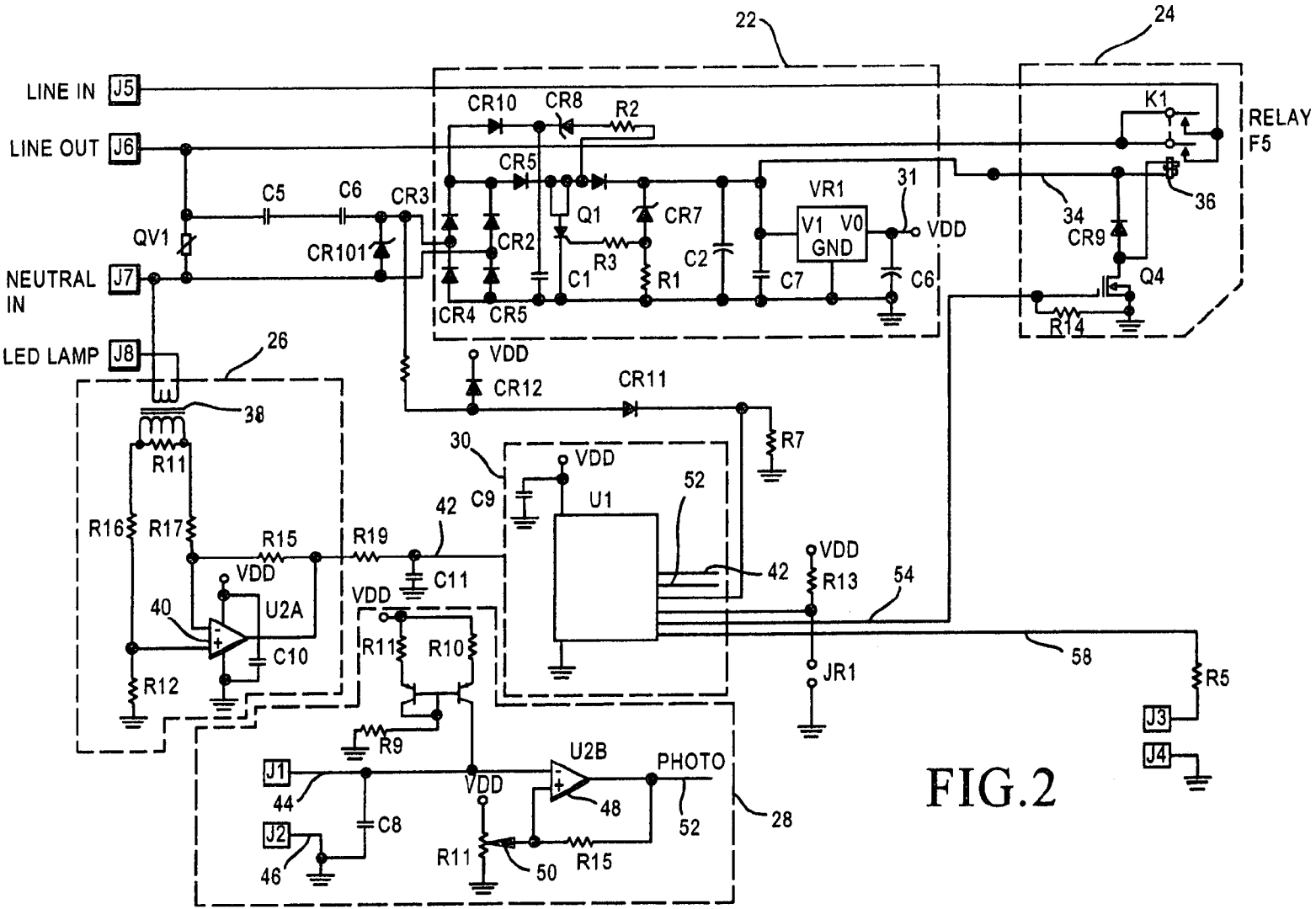
FIG. 2 is a schematic representation of an anti-cycling device according to the present invention.

FIG. 2 is a schematic representation of an anti-cycling device according to one embodiment of the invention. The principal elements of the circuitry of the anticycling device are a power supply section 22, a relay section 24, a current-sensing section 26, a photosensor section 28 and a microcontroller section 30.

The power supply section 22 provides regulated D.C. power ($V_{DD}$) on line 31 for operation of the microcontroller 32 of the microcontroller section 30 and other electronic devices of the circuitry. The power supply section 22 also supplies power along line 34 to operate the relay 36 of the relay section 24 that supplies and interrupts power to the lamp.

The current-sensing section 26 uses a current transformer 38 and operational amplifier 40 to monitor the lamp current and to output a signal on line 42 in response to the level of the current in the current transformer. This signal is used by the microcontroller section 30 to determine whether lamp cycling is occurring. The absence of substantial current flow indicates a lamp-off condition, and the presence of a current flow indicates a lamp-on condition.

A photosensor (not shown) is connected to the photosensor section 28 at lines 44, 46. The signal from this photosensor is input to one side of an operational amplifier 48. The other side of the operational amplifier is biased to a level by potentiometer 50. As a result, the operational amplifier 48 outputs a signal on line 52 that is used by the microcontroller section 30 to differentiate between day and night conditions according to the brightness sensed by the photosensor, which may be, for example, a device that changes resistance in response to variations in sensed light level. The photosensor section outputs a signal that varies depending on whether a day condition or a night condition is sensed by the photosensor section 28.

In the present embodiment, the microcontroller 32 of the microcontroller section 30 is a PIC 12C671 of the kind provided by Microchip Technology, Inc. of Chandler, Ariz. The microcontroller 32 includes a processor section, a program memory section and a RAM section, and has various input/output pins for receiving and outputting signals. The microcontroller 32 receives current and photosensor signals on lines 42 and 52, outputs relay control signals on line 54 and receives a 50 or 60 Hz signal derived from the A.C. power lines on line 56. A signal to operate an indicator LED can be provided by the microcontroller on line 58.

Figure 3:
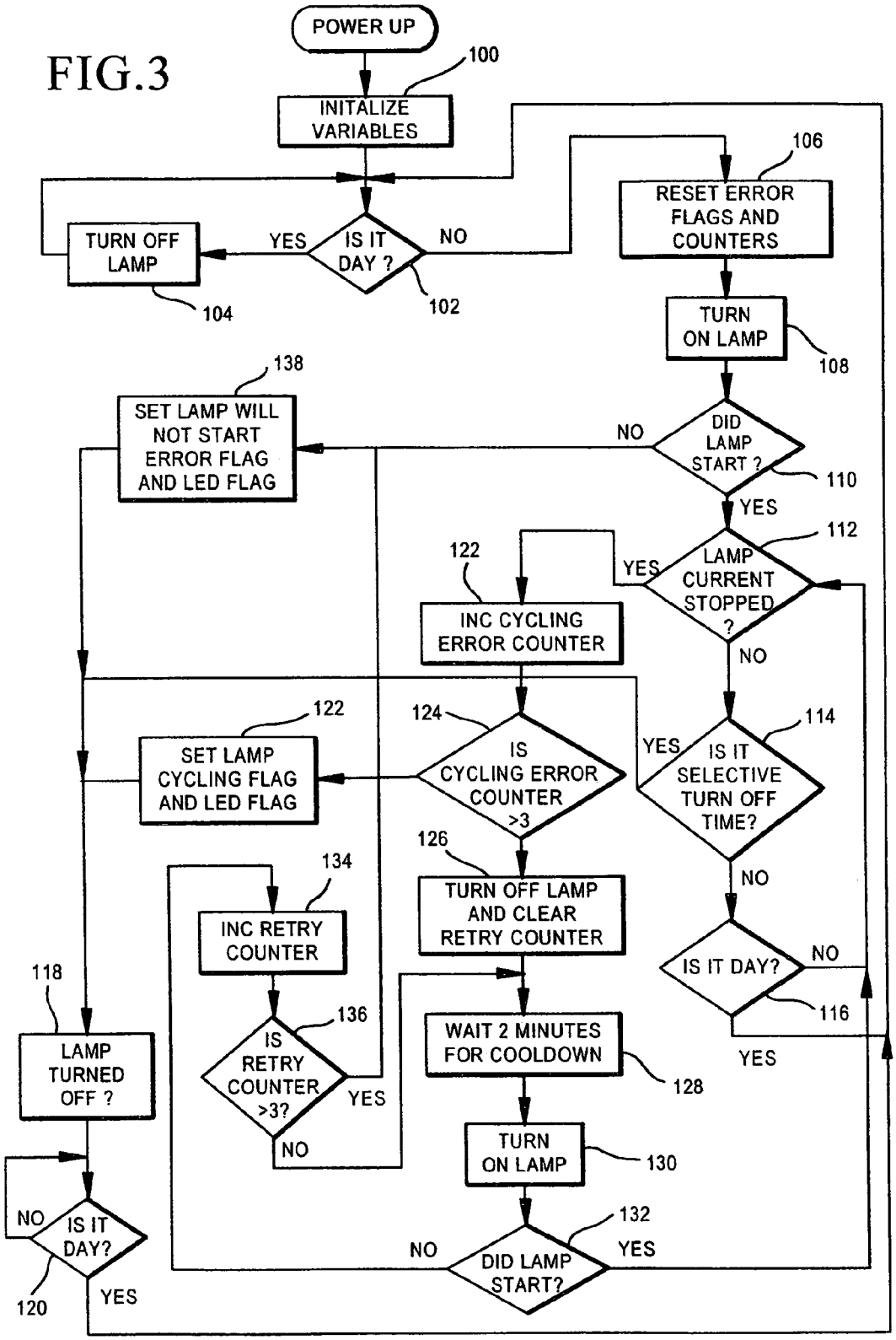
FIG. 3 is a functional flow diagram of the operation of the system.

The microcontroller 32 may be programmed to complete a variety of functions. In the present embodiment, and referring to FIG. 3, the microcontroller 32 may be programmed to operate in conjunction with the other systems of the anti-cycling device as follows.

When power is first applied to the microcontroller section 39 of the system, the first step 100 involves initializing the variables that will be used in operation of the microcontroller program. The system then proceeds to the next step 102 in which it detects whether it is night or day by sensing the signal output on line 52 provided by the photosensor section 28. If the signal indicates a day condition, operation passes to step 104 in which the microcontroller section 30 sets the output on line 54 to turn off power to the relay so that line power to the lamp is interrupted. Program execution then returns to the step 102 and continues the cycle of executing this step and step 104 until a night condition is detected.

Upon detection of a night condition, error flags and counters are reset in preparation for nighttime operation in step 106, and operation passes to step 108, in which the microcontroller section 30 outputs a signal on line 54 to energize the relay and supply power to the lamp. When power is applied to the lamp, (and hence to the ballast as well) current begins flowing through the current transformer 38 and a signal representative of the state of the current is output to the microcontroller section 30 on line 42 by the current-sensing section 26.

In the next step 110, the microcontroller section 30 senses the signal on line 42 to determine if the lamp has started. If so, in the next step 112 the current signal on line 42 is checked to determine whether the lamp has ceased operating. If the lamp continues to operate, as indicated by the current signal on line 42, the next steps 114, 116 involve checking whether the lamp should be turned off, either because a selective turn-off time has been reached or because the photosensor section is outputting a signal indicating that a day condition exists. So long as neither of these conditions exists, and as long as the lamp current has not stopped, the system will continue to cycle through steps 112, 114, 116, and lamp operation will not be interrupted. If, however, the selective turn-off time has been reached in step 114, the system turns off the lamp in step 118, and proceeds to the step 120 of repeatedly checking whether a day condition is detected. When a day condition is detected in this step 120, the system returns to the step 102 of checking for a day condition. Upon detection of a day condition in step 116, the system returns to the step 102.

If a cycling condition occurs, for example, because of the age of the lamp, and the loss of lamp current is sensed in the step 112 the system proceeds to the step 122 in which it increments the cycling error counter that counts the number of lamp off conditions sensed by the microcontroller section 30. The counter is then checked in the step 124 to determine if it has exceeded a cycling count parameter that, in the present embodiment, is a preset value (the value of 3, in the present embodiment), but which could be another parameter such as a rate of cycling events per hour. If more than three cycling events have been recorded, the system proceeds to the step 126 of setting the lamp cycling and LED flags, with the result that the LED will be operated by the microcontroller section 30 to provide an indication of a lamp cycling condition, which may involve causing the LED to flash on and off. The system then proceeds to the steps 118 and 120 in which the lamp is extinguished and the system continues to check for a day condition. Thus, in the event that more than three cycling events have occurred, the lamp is turned off for the night.

If the cycling error counter count does not exceed the preset value in the step 124, the system will attempt to restart the lamp. In order to do so, in the step 126, the system first turns the lamp off and clears the retry counter. The system then executes the step 128 of waiting for the expiration of a cool-down period, after which it attempts to restart the lamp in the step 130. In the present embodiment, the cool-down period is two minutes, but could be chosen as some other predefined parameter. During this cool-down period, the starter and ballast are not powered, so the likelihood of damage to these components is reduced. In addition, radio frequency interference may be reduced because the starter and ballast are not continually trying to restart the lamp during the cool-down period. Of course, the number of restarts and the duration of the cool-down period may be adjusted as desired. In addition, more complex anti-cycling protocols could be implemented in other embodiments, such as adjusting the number of permitted cycling events according to the duration of the night condition or in accordance with the time between such cycling events.

After attempting to restart the lamp, the system next checks whether the lamp has restarted in the step 132 by checking the current signal on the line 42. If the lamp has not restarted, the system proceeds through the steps 134 and 136 of incrementing the retry counter and testing the counter against the maximum retry limit. So long as the maximum retry limit is not exceeded (in this case, three retries) the system returns to the steps 128, 130, 132 of waiting through a cool-down period, attempting to restart the lamp and checking whether the lamp has restarted. This continues until the maximum limit of the retry counter has been found to be exceeded in the step 136.

If the maximum retry limit is found to have been exceeded in the step 136, or if the lamp has been found to have failed to start in the step 110, the system proceeds to the step 138, in which it sets the lamp will not start and the LED flags. The system provides power to the LED when the LED flag is set to provide a visual indication of the fault. The lamp is then powered down in the step 118 by de-energizing the relay, and the system proceeds to the step 120 of waiting for a day condition to be sensed by the photosensor and photosensor system 28.

Returning to the step 132, if the lamp has restarted after the cool-down period and the lamp turn-on steps 128, 130, the system returns to the step 112 of checking whether lamp current has ceased flowing.

Embodiments of the invention may have a selective turn-off function. One method of saving substantial energy as well as postponing the need for maintenance is to selectively turn off some of the lamps that may not be needed for safety purposes. For example, it may be desired to turn off every second or third lamp along a street for a portion of the evening. This could be implemented by a simple timer, as, for example, a routine that uses the signal on the line 56 to count down from a preselected number representing a desired time period. Upon reaching zero, the system would terminate power to the lamp. However, as the length of night varies substantially from season to season except in equatorial regions, another method of determining the turn-off time for the selected lamps might be implemented that takes these variations into account.

Figure 4:
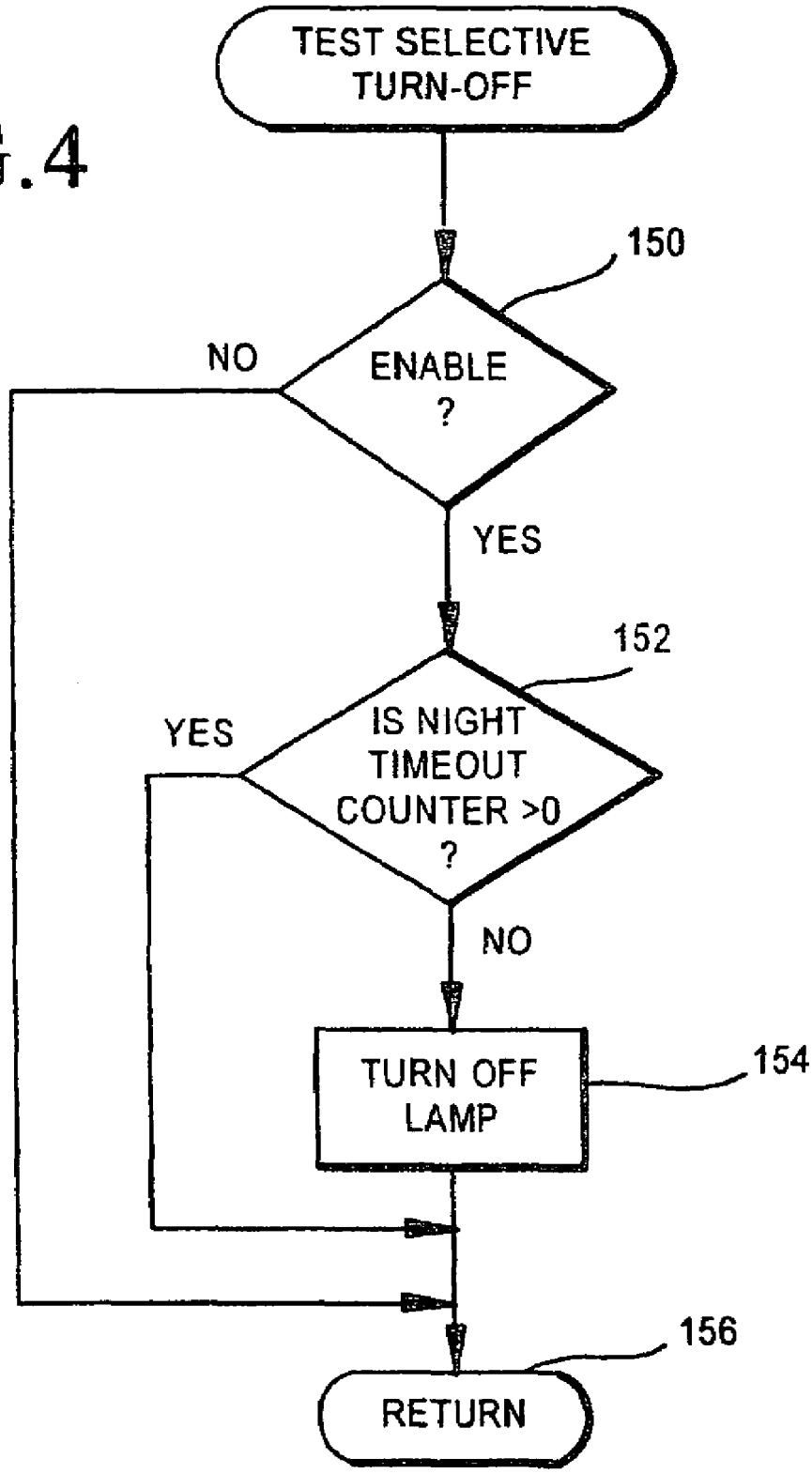
FIG. 4 is a functional flow diagram of a selective turn-off routine for a system operated according to the functional flow diagram of FIG. 3.

One embodiment of the invention uses such a method for determining a selective turn-off time. This method can be implemented in the system of FIG. 2. As shown in FIG. 4, in one embodiment, the selective turn-off condition can be determined as follows. During interrupt servicing, the system can execute a series of steps to determine whether a selective turn-off condition exists. In the first step 150, the system checks whether selective turn-off was enabled when the system was initially set up or subsequently serviced. If the system is not set up for selective turn off, then the test for selective turn off time in the step 114 would always come back negative, and no selective turn-off would occur.

If selective turn-off is enabled, however, the system proceeds to the step 152, in which it decrements the turn-off counter and checks whether the value in the counter is still greater than zero. If the value of the counter is found not to be greater than zero, then the system sets a selective turn-off flag in the step 154, and the selective turn-off routine concludes its processing in the step 156 and returns. This selective turn-off flag is checked in the step 114 (shown in FIG. 3) to determine whether the lamp should be shut off by proceeding to the step 118. If the selective turn-off counter has not yet reached zero in the step 152, the routine concludes its processing in the step 156 and returns without the selective turn-off flag having been set.

In the present embodiment, the initial turn-off counter value is calculated when a night condition is detected. During operation of the device, a night counter is continuously incremented in response to a signal such as that provided to the microcontroller 32 on line 56. When a day condition is sensed, the value in the night counter is preserved, and a day counter begins to be incremented from zero. When a night condition is once again sensed, the day and night counters are checked to determine if together they correspond to the length of a day. If so, the values in the previous day's night and day counters are reset to the corresponding new night and day counter values, and the initial turn-off counter value is set in the present embodiment as a function of the night counter value, such as, for example, a value that will result in turn off after one half or two thirds of the night has passed.

Figure 5:
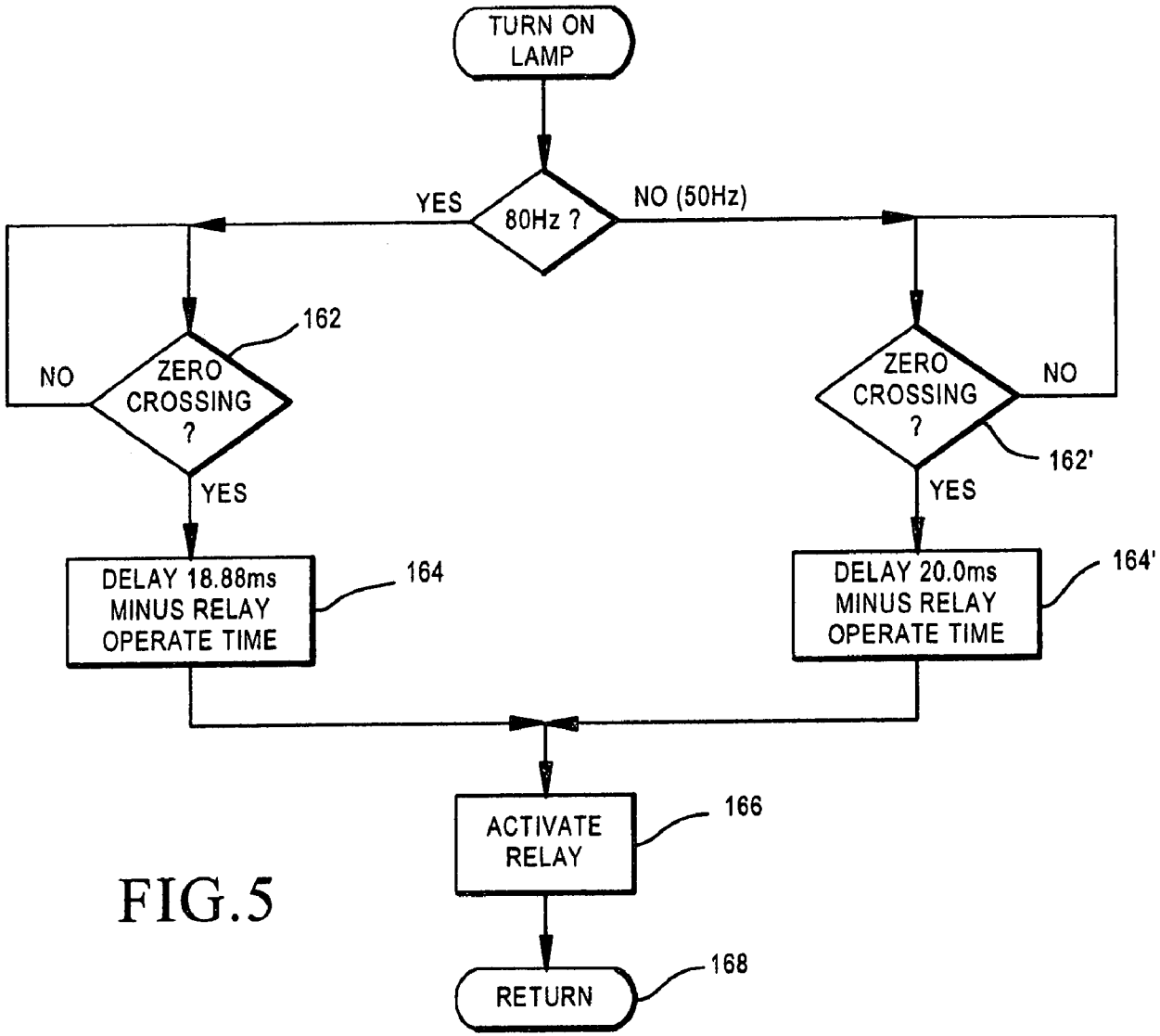
FIG. 5 is a functional flow diagram of a selective turn-off routine for a system operated according to the functional flow diagram of FIG. 3.

Referring to FIG. 5, in another embodiment of the invention, the steps 108, 130 of turning on the lamp involve a zero-crossing turn-on. According to this embodiment, when the system determines that the lamp should be turned on, it takes several steps to cause the system turn on to occur at the point at which the alternating current line voltage is at zero. For systems such as the present, this can reduce arcing across the contacts of the relay. In addition, supplying power to the lamp at the zero voltage crossing may extend the life of the ballast, starter, controls and lamp. The zero voltage crossing turn-on function may be implemented as shown in FIG. 5 as follows. The first step 160 is to determine whether the system is operating in a 50 or 60 Hz environment. This may be set at the factory, or when the system is initially set up. In the case of 60 Hz electricity, the system then checks for a zero crossing in the step 162, and continues to perform this step until a zero crossing is detected. When a zero crossing is detected by a change in the signal on the line 56, the system processes a delay in the step 164 to wait for a subsequent zero crossing. This delay may be, in the case of 60 Hz electricity, a delay of 16.66 ms (the time for one cycle of the alternating current) minus the relay operation time. For a relay with a 2 ms operation time, for example, the total delay would then be 14.66 ms. Upon expiration of the delay, the system executes the step 166 in which a signal on line 54 causes the relay to operate and supply power to the lamp. The system then concludes operation of this routine and returns in the step 168.

The system functions in an analogous manner in the event that it determines in step 160 that the line current is 50 Hz. That is, the system continuously checks for a zero crossing in the step 162' and then processes a delay corresponding to the 20 ms duration of a single cycle of the 50 Hz electricity minus the relay operation time in the step 164'. Operation of the relay then proceeds in the step 166 as discussed above.

In another embodiment, a zero-crossing turn-off of power to the lamp is implemented in an analogous manner. That is, after a zero crossing is detected, the system waits for a time period of 16.66 ms for 60 Hz electricity and 20 ms for 50 Hz electricity, in either case minus the relay operation time, so that the relay breaks contact approximately when the line voltage crosses zero.

Figure 6:
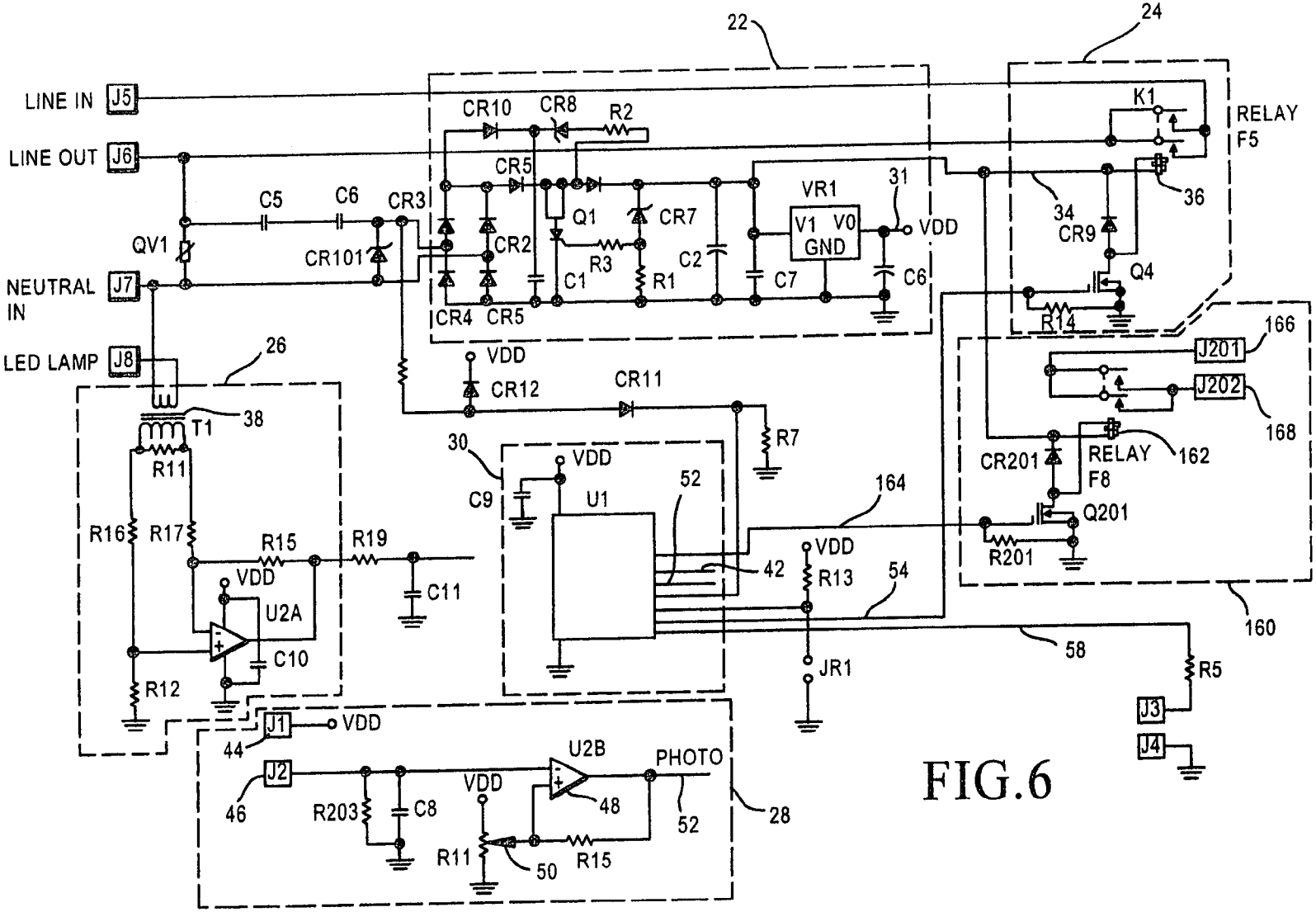
FIG. 6 is a schematic representation of an anti-cycling device according to the present invention similar to that of FIG. 2, but with additional circuitry for dimming of luminaires.

For safety or other reasons, it may be desired to dim a luminaire rather than turning it off. FIG. 6, in which like elements to those of FIG. 2 bear the same numbers, is a schematic for an anti-cycling control circuit that is capable of dimming luminaires rather than turning them off. Luminaires using auto regulator (CWA) or regulator (CWI) type ballasts include capacitors in their circuitry. Changes to the capacitance results in changes to the power factor. For CWA ballasts, a reduction of 40% in light output can result in about a 30% saving in power usage.

Figure 7:
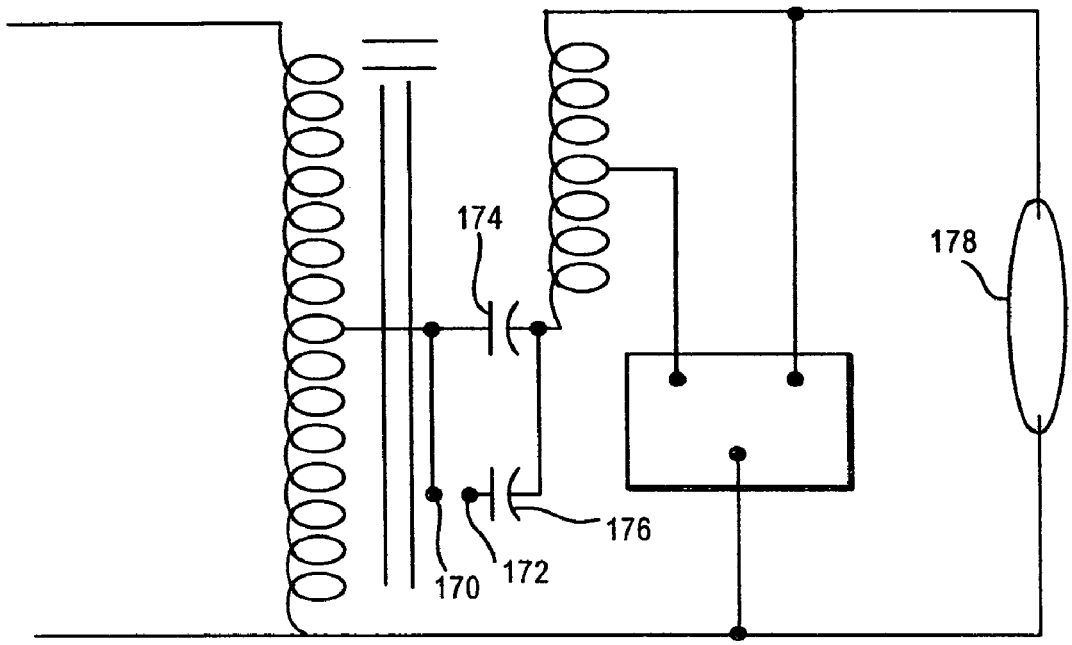
FIG. 7 is a schematic of an auto regulator (CWA) ballast and lamp for a luminaire.

The schematic of FIG. 6 includes differs from that of FIG. 2 principally in the addition of a second relay section 160 and in modifications to the photosensor section 28. The second relay section 160 comprises a relay 162 that is operated to change between open and closed positions in response to signals from the microcontroller section 30 received along line 164. The relay 162 may be operated to open and close at zero voltage crossings as described in connection with the operation of the relay 36. The relay is connected to terminals 166, 168. These terminals are connected to the inputs 170, 172 of the CWA ballast circuit of FIG. 7. The ballast circuit includes two capacitors 174, 176. When the contacts of the relay 162 are closed, the capacitor 176 is connected in parallel with capacitor 174. In this state, the lamp 178 operates at high light output. When the contacts of the relay 162 are open, capacitor 176 is no longer connected in parallel with capacitor 174, and the capacitance of the system is reduced. In this state, the lamp 178 is dimmed.

Figure 8:
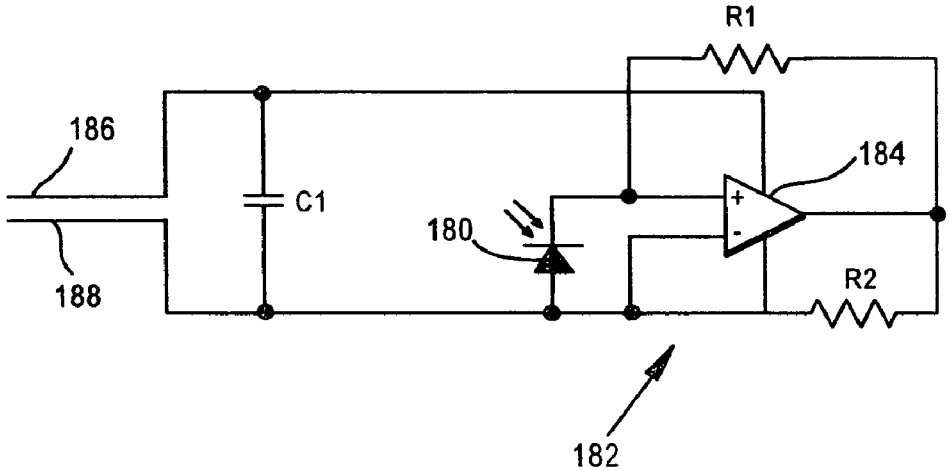
FIG. 8 is a schematic of a photodiode light sensor system.

The photosensor section 28 of FIG. 6 may be used in connection with a photodiode 180 and pre-amplifier 182, as shown in FIG. 8. The photodiode 180 controls the output of the operational amplifier 184, which outputs a signal on twisted-pair output lines 186, 188 to the photosensor section 28 of FIG. 6.

Figure 9:
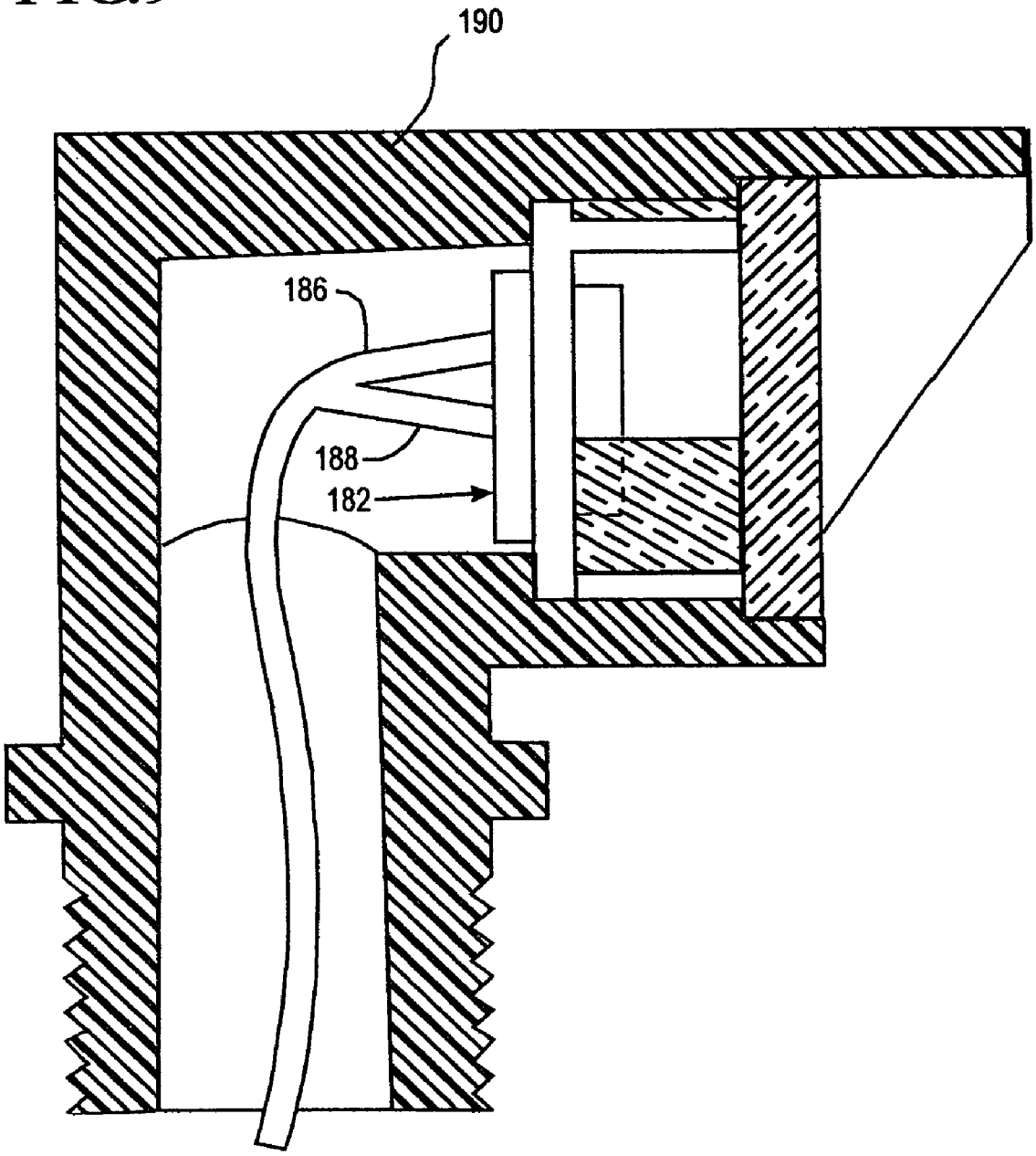
FIG. 9 is a sectional side view of a photosensor unit for use with a luminaire.

Referring to FIG. 9, the photodiode 180 (not shown) and preamplifier 182 may be mounted in a sensor housing 190 that is mounted remotely from the lamp control circuitry, such as that depicted in FIG. 6. The photodiode 180 is mounted such that it can receive light from the lens 192. If the peak sensitivity of the photodiode is in the infrared range, a blue-tinted lens may be used to alter the effective peak wavelength of the system to more nearly approximate daylight.

In operation, the microcontroller 32 may be programmed in the present embodiment to control dimming of the lamp 178. The microcontroller may accomplish this by operating the relay 162 by changing the state of the lamp-dimming signal sent along line 164. A signal that operates the relay to move the contacts to the open position reduces the capacitance of the system of FIG. 7, thereby dimming the lamp 178. Such dimming may be in response to a timer, or selective dimming may be used. Such selective dimming may be analogous to the selective turn-off discussed above in connection with FIG. 4, with the system calculating a lamp dimming value analogous to the lamp turn-off value. In the present embodiment, the dimming is not engaged until completion of a warm-up period for the lamp. Such a warm-up period may be a fixed period, such as 15 minutes from the last start or restart, as determined by the microcontroller 32 by reference to a counter that is reset each time the lamp 178 is restarted.

Although specific embodiments of the invention have been disclosed herein for the purpose of illustration, various modifications and additions may be made without deviating from the spirit and scope of the invention. The scope of protection of the invention should thus be determined by reference to the appended claims.

I claim:

1. A method of controlling operation of a luminaire that includes a high pressure sodium lamp comprising:

monitoring the on-off condition of the lamp;

upon detection of a lamp off condition, performing a delayed lamp restart procedure by interrupting power to the lamp during a cool-down period, restoring power to the lamp after the cool-down period and checking the on-off condition of the lamp to determine whether the lamp has restarted; and disabling the lamp if the lamp fails to restart after the performing of the delayed lamp restart procedure.

2. The method of claim 1 wherein the delayed restart procedure is repeated a predetermined number of times prior to the lamp being disabled for failure to restart.

3. The method of claim 2 further comprising the steps of detecting a night condition, monitoring the occurrence of a lamp off condition during the night condition and interrupting power to the lamp when the occurrences of the lamp off conditions exceeds a predefined parameter.

4. The method of claim 3 wherein the power to the luminaire is supplied in the form of an alternating current and further comprising the steps of sensing a zero voltage crossing of the alternating current and applying power to the lamp in response to the sensing of the zero voltage crossing.

5. The method of claim 1 wherein the off condition of the lamp is determined based on current flowing to the lamp.

6. The method of claim 1 wherein the power to the luminaire is supplied in the form of an alternating current and farther comprising the steps of sensing a zero voltage crossing of the alternating current and applying power to the lamp in response to the sensing of the zero voltage crossing.

7. The method of claim 1 further comprising the steps of detecting the start of a night condition and interrupting power to the lamp prior to the end of the night condition.

8. The method of claim 7 further comprising the steps of determining a value representative of the length of a prior night condition, calculating a lamp turn-off value representative of a portion of said value, the timing of the interrupting of power to the lamp being responsive to the calculated lamp turn-off value.

9. The method of claim 7 further comprising the steps of determining a value representative of the length of a prior night condition, calculating a lamp dimming value representative of a portion of said value, and dimming the lamp in response to the lamp dimming value.

10. The method of claim 1 further comprising the steps of detecting the start of a night condition and reducing power to the lamp prior to the end of the night condition.

11. A method of preventing cycling in high pressure sodium lamps, the method comprising:

detecting a lamp off condition;

interrupting power to the lamp for a defined period of time to enable the lamp to cool-down;

providing power to the lamp after the defined period of time;

determining if the lamp was restarted subsequent to the providing power; and disabling the lamp if the lamp fails to restart.

12. The method of claim 11, further comprising repeating the interrupting, the providing and the determining after a failed restart; and tracking failed restarts;

wherein the disabling includes disabling the lamp if the failed restarts exceeds a predefined threshold.

13. The method of claim 11, wherein the detecting a lamp off condition includes detecting a lamp off condition during night conditions when a selective turn-off was not initiated.

14. The method of claim 11, wherein the detecting includes detecting the lamp off condition by determining current is not flowing to the lamp.

15. The method of claim 11, further comprising turning a fault indicator on if the lamp is disabled.

16. The method of claim 15, wherein the fault indicator is a flashing LED.

17. A method of controlling operation of a high pressure sodium lamp, the method comprising:

detecting a night condition;

initiating a lamp on sequence subsequent to the detection of the night condition;

detecting a lamp off condition;

interrupting power to the lamp for a defined period of time to enable the lamp to cool-down;

initiating a lamp on sequence after the defined period of time;

determining if the lamp was turned on in response to the lamp on sequence;

tracking failed turn on of the lamp; and disabling the lamp if the failed turn on tracking exceeds a defined threshold.

18. The method of claim 17, further comprising tracking lamp off conditions; and disabling the lamp if the lamp off conditions exceeds a predefined threshold.

19. The method of claim 17, further comprising calculating expected length of night condition; and turning lamp off or dimming lamp for portion of the expected length of the night condition.

20. The method of claim 17, wherein the initiating a lamp on sequence includes sensing a zero voltage crossing of an alternating current and applying power to the lamp at the zero voltage crossing.

21. The method of claim 17, further comprising turning on a visible fault indicator if the lamp is disabled.

22. The method of claim 21, wherein the lamp stays disabled and the visible fault indicator stays on until a next night condition is detected.

* * * * *